US007708492B2

(12) United States Patent
Carey

(10) Patent No.: US 7,708,492 B2
(45) Date of Patent: May 4, 2010

(54) RELOCATABLE TENSIONED WIRE ROAD BARRIER

(76) Inventor: Anthony Carey, 4801 Feather River Blvd., Suite 3, Oroville, CA (US) 95965

( * ) Notice: Subject to any disclaimer, the term of this patent is extended or adjusted under 35 U.S.C. 154(b) by 0 days.

(21) Appl. No.: 11/943,196

(22) Filed: Nov. 20, 2007

(65) Prior Publication Data

US 2008/0118305 A1 May 22, 2008

(30) Foreign Application Priority Data

Nov. 20, 2006 (AU) ..... 906451

(51) Int. Cl.
*E01F 15/00* (2006.01)

(52) U.S. Cl. ..... 404/6

(58) Field of Classification Search ..... 404/6; 256/13.1

See application file for complete search history.

(56) References Cited

U.S. PATENT DOCUMENTS 4,681,302 A * 7/1987 Thompson ..... 256/13.1
5,208,585 A * 5/1993 Sprague ..... 340/908.1
5,425,594 A * 6/1995 Krage et al. ..... 404/6
5,531,540 A * 7/1996 Wasserstrom et al. ..... 404/6
5,605,413 A * 2/1997 Brown ..... 404/6
5,685,665 A * 11/1997 Lembo ..... 404/6
5,769,563 A * 6/1998 Flynn ..... 404/15
6,439,801 B1 * 8/2002 Galiana et al. ..... 404/6
6,669,402 B1 * 12/2003 Davis et al. ..... 404/6
6,679,649 B1 * 1/2004 Capolupo ..... 404/6
6,848,857 B1 * 2/2005 McColl et al. ..... 404/6
6,863,468 B2 * 3/2005 Davis et al. ..... 404/6
2003/0219308 A1 * 11/2003 Boulais et al. ..... 404/6

* cited by examiner

*Primary Examiner*—Gary S Hartmann
(74) *Attorney, Agent, or Firm*—Kirton & McConkie; Evan R. Witt

(57) ABSTRACT

A road traffic barrier module comprises a hollow body adapted to receive ballast and adapted at either end to link with similar modules to form a barrier in which there is a pair of upper and lower horizontal bolts passing through mating ends of adjoining modules and there is also a pair of cables the ends of which are also secured by the bolts. In an alternative form adjoining modules are linked by vertical pins passing through mating ends of the adjoining modules and there is a pair of cables the ends of which are also secured by the pin. The modules are molded from a plastic material and the walls may also be clad with metal pressings to increase structural integrity and to protect against damage.

16 Claims, 17 Drawing Sheets

RELOCATABLE TENSIONED WIRE ROAD BARRIER

FIELD OF THE INVENTION

This invention relates to ballast filled relocatable barrier systems designed to provide a temporary crash barrier for road traffic but also to provide a "soft" impact for vehicles and passengers.

BACKGROUND OF THE INVENTION

The earliest road traffic barriers for use at worksites were made from concrete and have a broad base which tapered to an apex such as disclosed in U.S. Pat. No. 4,059,362. Although they provide an effective barrier and are still widely used, the impact of a vehicle with them usually causes severe damage to both the vehicle and its occupants.

Accordingly concrete barriers have been progressively replaced at worksites by hollow modules made from semi rigid plastic material, usually polyethylene, which are filled with water to increase their weight and to provide an effective barrier, such as disclosed in AU Patent 664774. The aim is for the barrier to deform and move moderately when impacted by a vehicle thus absorbing the impact energy and minimizing damage to the vehicle and its occupants.

However the latter molded barrier is much the same shape as the earlier concrete barriers and vehicles tend to climb up them and roll over which still causes considerable damage. An early attempt to both strengthen a coupled chain of water filled barriers and to also soften the impact of a vehicle with the barrier is taught in U.S. Pat. No. 5,531,540. Here a pair of continuous tubular crash rails is mounted on the side walls of water filled modules by means of metal brackets strapped to the modules.

Although the mounting brackets of this configuration have been variously modified in later versions, it still does not achieve the optimum trade off between providing a barrier which limits the travel of an impacting vehicle and at the same time minimizes damage to the vehicle and its occupants. A further attempt to achieve this trade off is disclosed in AU Patent 751778 where the cross section of the water filled module is changed from an A shape to a castellation shape with an enlarged top section to prevent the vehicle wheel from climbing the barrier. The modules are also firmly bolted together to provide a continuous barrier which resists fracture.

AU Patent 774224 takes a step back toward the rigidity of the original concrete barriers by tying water filled modules together with a metal beam which is mounted on and overlies the side walls of at least two adjoining modules. The resulting barrier tends to have the rigidity of a concrete barrier and very little impact energy is absorbed by the barrier. Accordingly the vehicle and its occupants absorb most of the impact energy which usually causes severe damage.

In our PCT Application WO2004009909 we also teach the use of a metal beam but in a quite different way from AU774224 in that the beam is mounted on individual modules by means of a deformable bracket. Accordingly the beam and brackets absorb the initial impact energy and because they do not tie the modules together, the chain of coupled modules is still flexible enough to absorb further kinetic energy by flexing within the standard limits of displacement for road barriers. We have found that this arrangement meets the requirements of Australian New Zealand Road barrier Standard 3845-1999 and US NCHRP 350 for road safety barrier systems. Road safety barrier systems are now required to meet crash test standards set by road regulatory State and Federal agencies.

Another attempt to combine flexibility with limited displacement in barriers having water filled modules of castellated cross sectional shape has been made by fitting an internal steel frame, tying the modules together using cables running over the top of the modules. The cables are clamped to fixtures on each module thus forming a continuous linked barrier. However clamping the cables on top of the modules is time consuming and lack of tension in the cables is not ideal for the integrity of the linked barrier. Further the system suffers from uncontrolled deflection and cannot be used where traffic buffer space is restricted.

OBJECT OF THE INVENTION

It is therefore an object of the present invention to provide a road barrier with ballast filled modules containing tensioned cables interconnected internally throughout the system which overcomes the disadvantages of the above barriers or at least provides a useful alternative.

STATEMENT OF THE INVENTION

According to the present invention a road traffic barrier module comprises a hollow body adapted to receive ballast and adapted at either end to link with similar modules to form a barrier, and at least one cable longitudinally secured within the body to increase the structural integrity of the barrier.

Preferably adjoining modules are linked by at least one connector passing through mating structures at the ends of the adjoining modules.

Preferably the ends of the cable are also secured by the mating structures.

Preferably there is a pair of upper and lower horizontal bolts passing through mating structures of adjoining modules and there is also a pair of cables the ends of which are also secured by the bolts.

Preferably the ends of the cables are formed in eyelets around tubes through which the bolts pass.

In an alternative configuration, adjoining modules are linked by a vertical pin passing through mating structures of the adjoining modules and there is a pair of cables the ends of which are also secured by the pin.

In one configuration, cables in one module are coupled to cables in an adjoining module in a substantially co-linear configuration.

Preferably the ends of the cables attach to C couplings which are molded into the mating structures of the module and which are secured by the vertical pin.

Preferably the ends of the cables have threaded members which are retained in the C couplings by adjustable nuts. Preferably the modules have hatches which provide access to the adjustable nuts for tensioning the cable. Preferably the cable is secured within the body interior between the first and second linking ends under tension.

Preferably the C couplings engage tubes which are molded into the mating structures of the module and aligned to receive the vertical pin.

Preferably the vertical pin is adapted to engage an anchor fixed in the ground beneath the module.

Preferably the lower end of the vertical pin is threaded to screw into the top of an augur which is screwed into the ground as an anchor.

Preferably the modules are molded from a plastic material and their walls are clad with metal pressings which increase the structural integrity of the module and protect it against damage.

BRIEF DESCRIPTION OF THE DRAWINGS

An embodiment of the invention is now described by way of example only with reference to the accompanying drawings in which:

FIG. 6 is an internal side elevation of the module of FIG. 5;

FIG. 13 is a section through AA of FIG. 11;

DETAILED DESCRIPTION OF THE INVENTION

Figure 1:
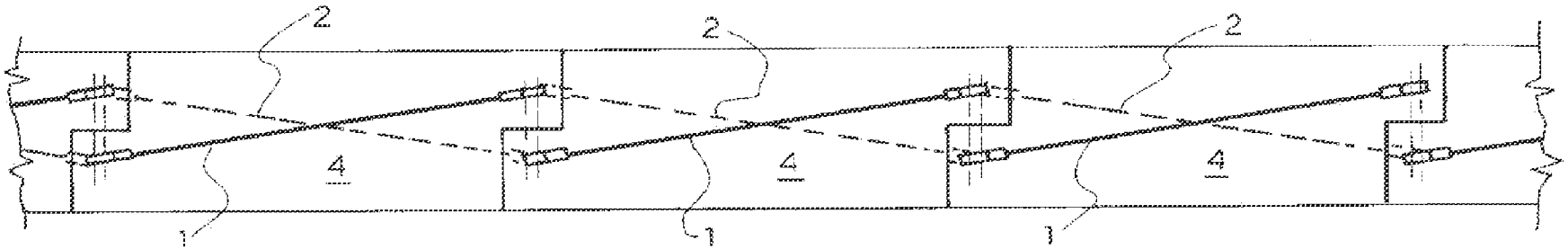
FIG. 1 is a sectioned plan view of three linked modules showing the location of a pair of internal cables in each module.
Figure 2:
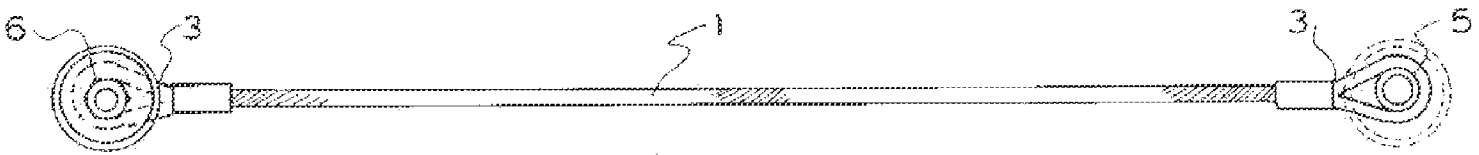
FIG. 2 is a side view of an individual cable in situ.
Figure 3:
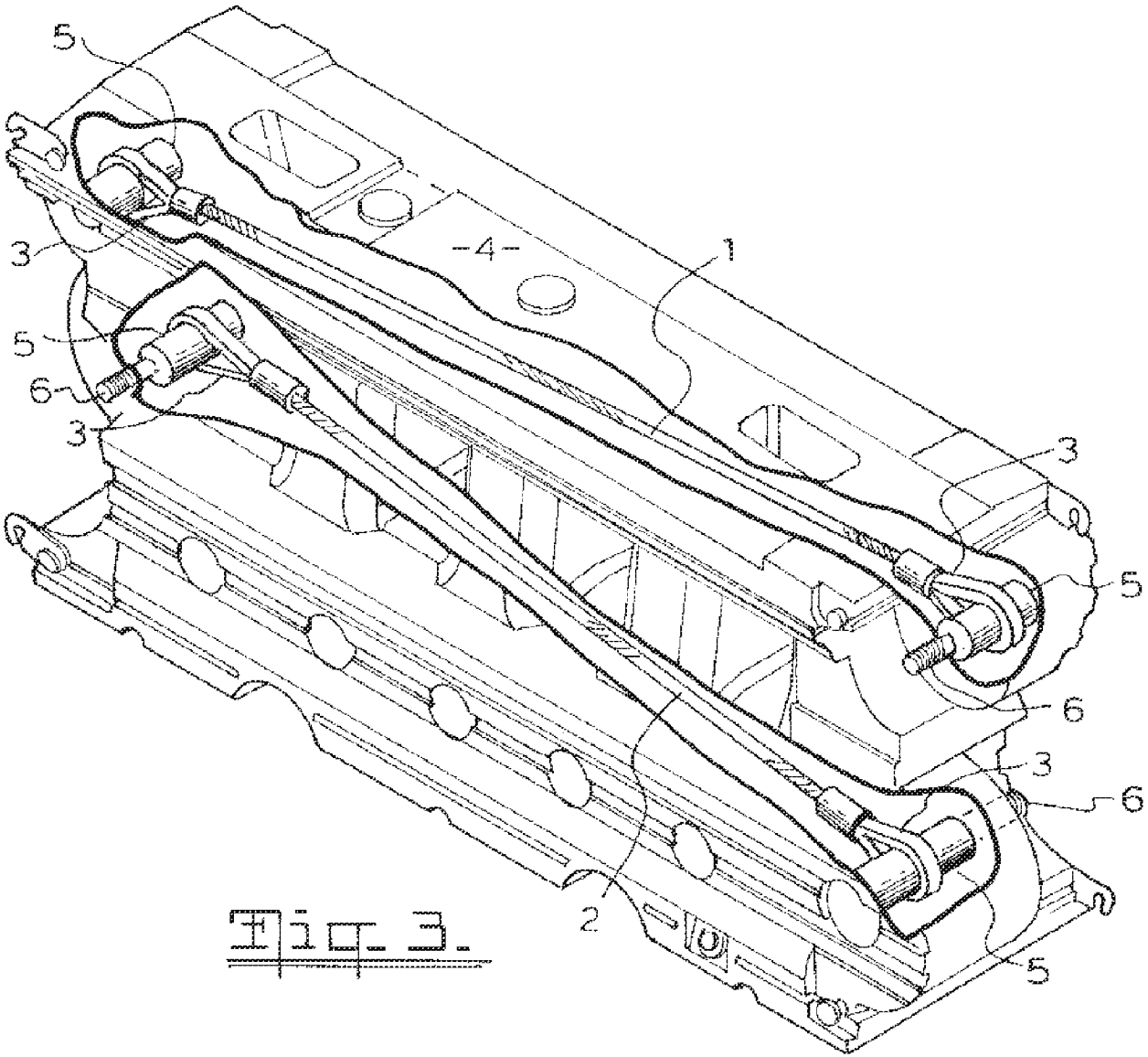
FIG. 3 is an isometric view of a module exposing a pair of internal cables.
Figure 4:
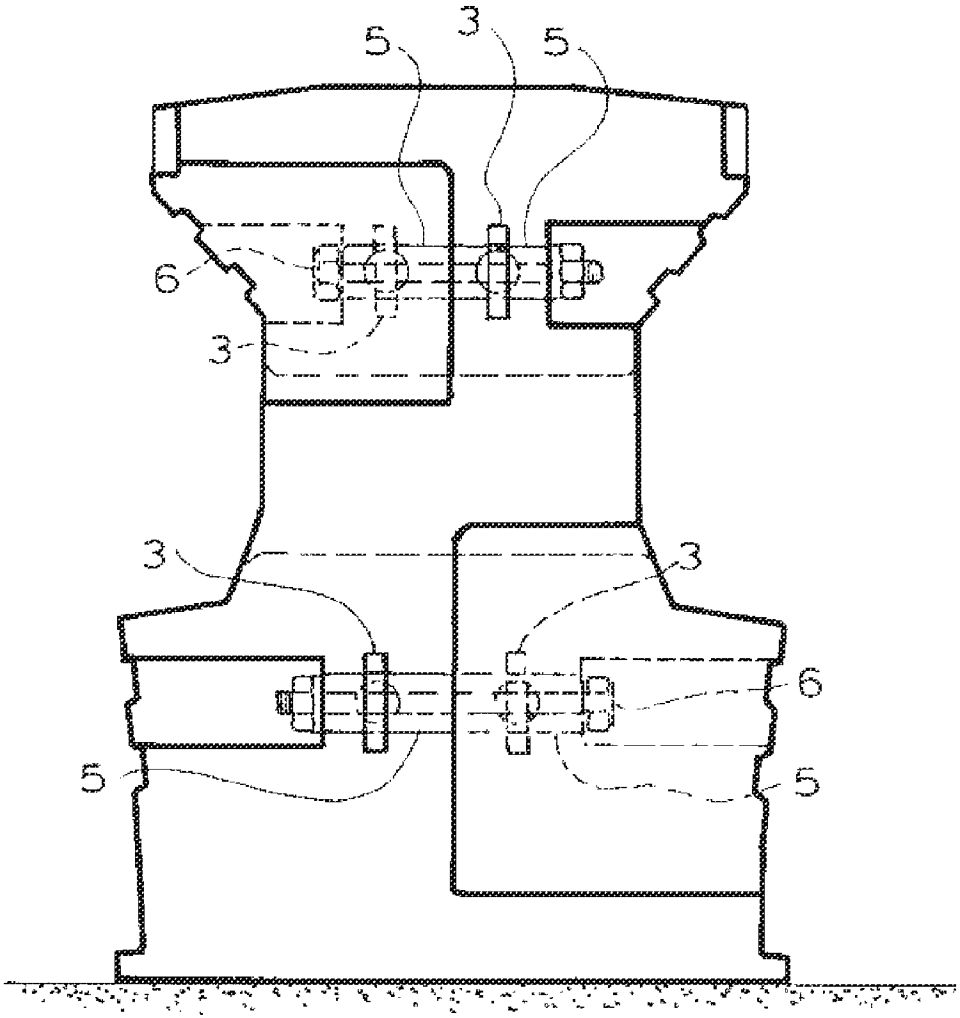
FIG. 4 is an end elevation sectioned to show horizontal bolts connecting two modules.

FIG. 1 illustrates the internal upper 1 and lower 2 cables of three linked modules 4 with eyes 3 formed at the end of each cable 1,2 as shown in FIG. 2. The location of the upper cable 1 and the lower cable 2 within the hollow body of module 4 is shown in FIG. 3. The eyes 3 of cables 1, 2 are secured by tubes 5 molded into the body of module 4.

Bolts 6 are used to link modules 4 together and at the same time to secure cables 1, 2 via end eyes 3 which are held by molded tubes 5. Accordingly the modules 4 form a linked barrier which is reinforced by continuously connected internal cables 1, 2. The resulting barrier combines high structural strength with high flexibility and is capable of absorbing maximum impact energy by flexing within specified limits of deflection.

Figure 5:
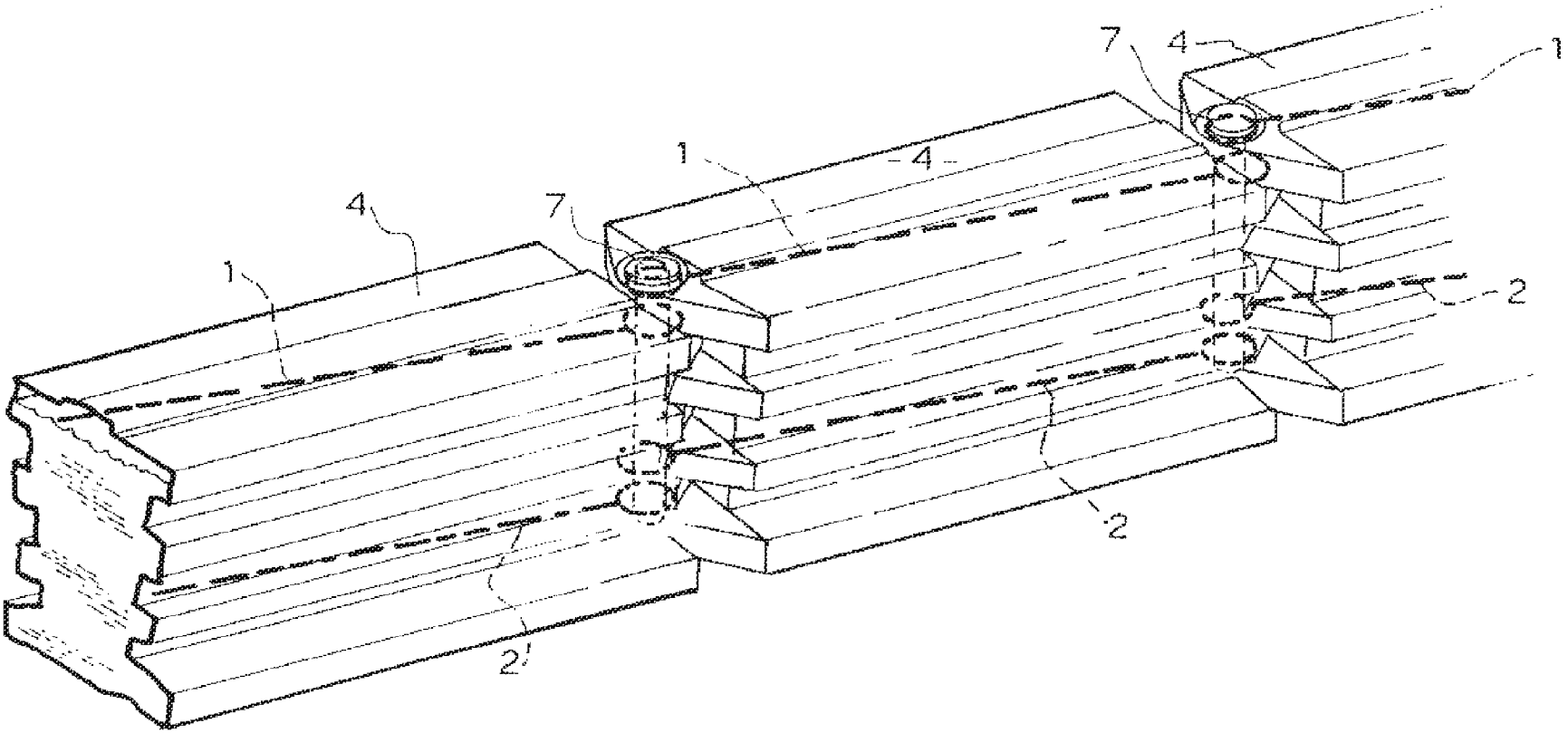
FIG. 5 is an isometric view of an alternative module in which modules are linked by vertical pins.
Figure 5:
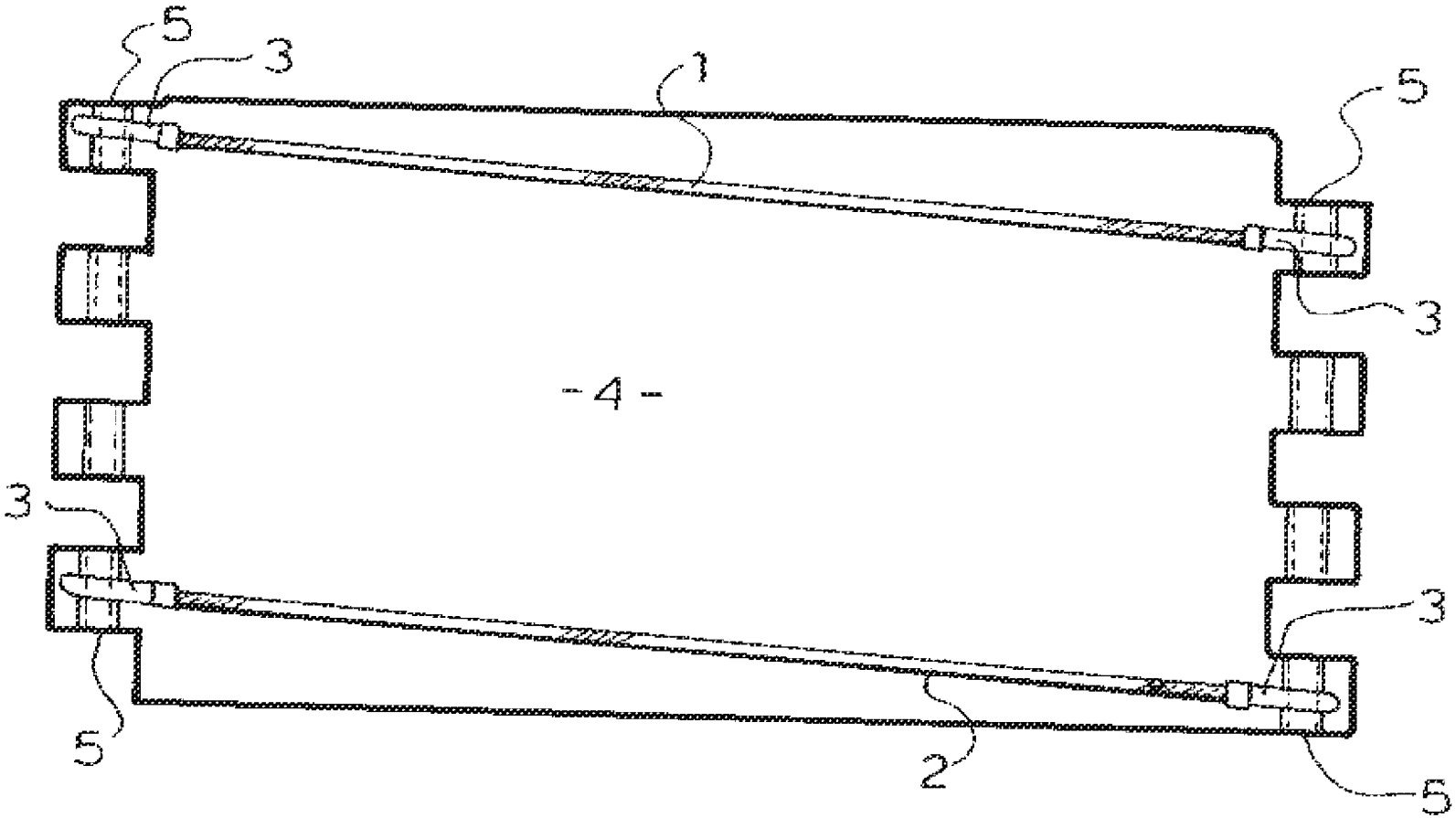
Figure 7:
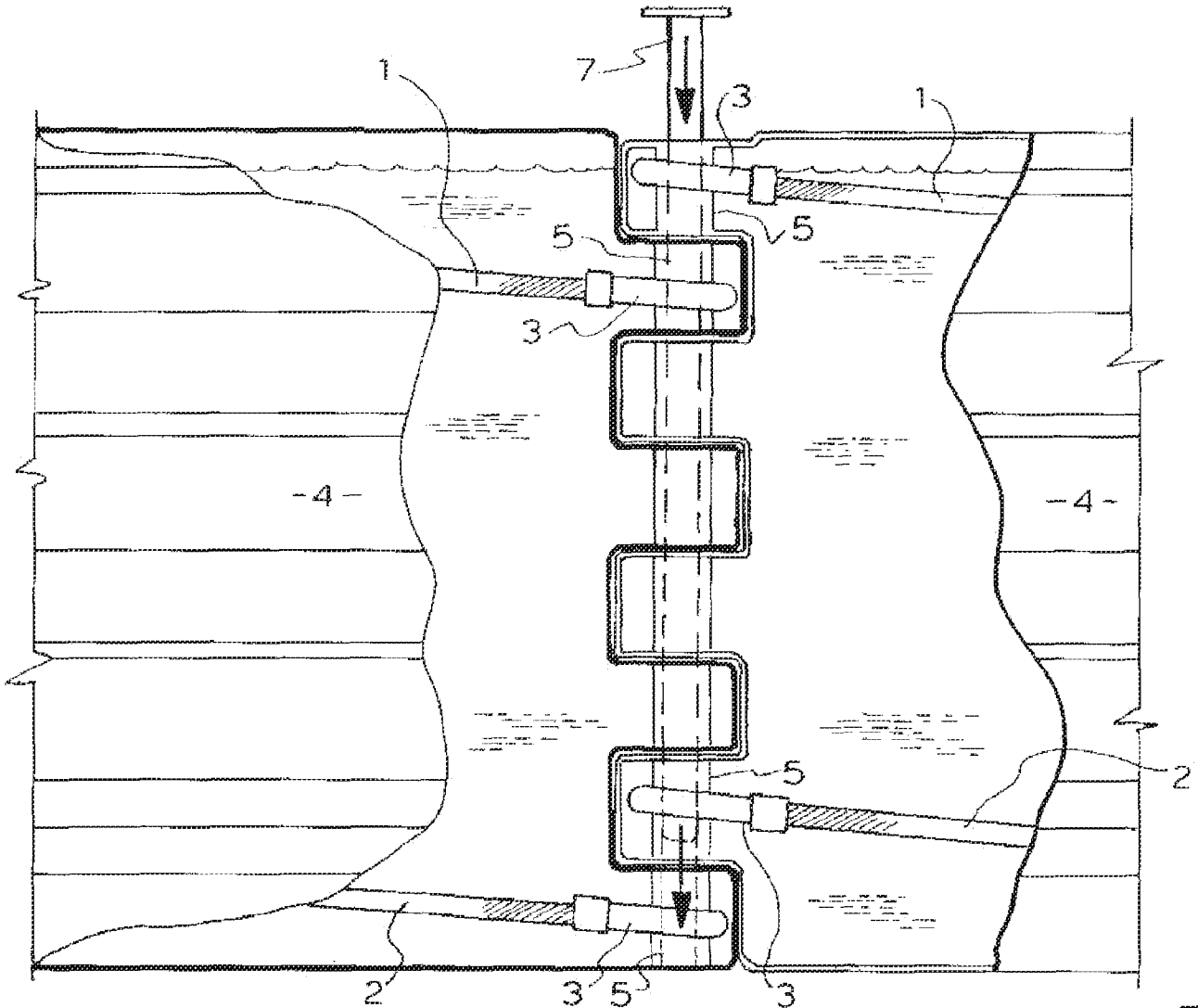
FIG. 7 is an exposed view showing the pin connecting the modules of FIG. 5.

FIGS. 5, 6 and 7 illustrate an alternative linking system wherein modules 4 are joined by vertical pins 7. Internal cables 1 and 2 reach between molded tubes 5 which are vertical and receive pin 7 which thereby links both cables 1, 2 and modules 4 together securely in a continuous barrier. Once again the structural integrity of the barrier is ensured by the continuously connected cables 1, 2 which allow maximum specified flexing to absorb impact energy.

It will be obvious that cables 1, 2 in both the above configurations are contained securely inside modules 4 which are also hold ballast. Cables 1, 2 and eyelets 3 are made from non corrosive material such as stainless steel or are plated by galvanizing or similar treatment.

Figure 8:
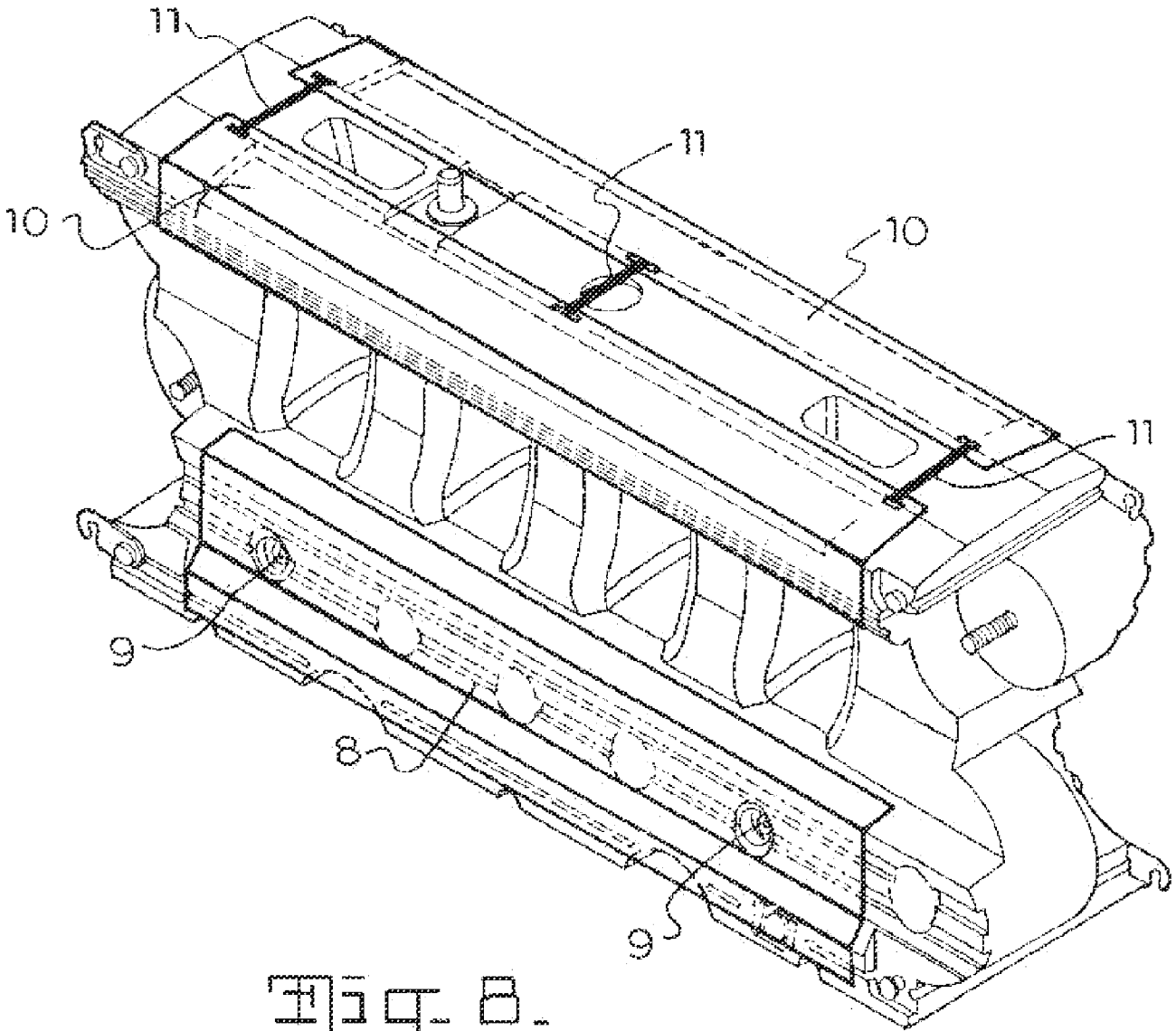
FIG. 8 is a perspective view of the module of FIG. 3 with metal cladding.
Figure 9:
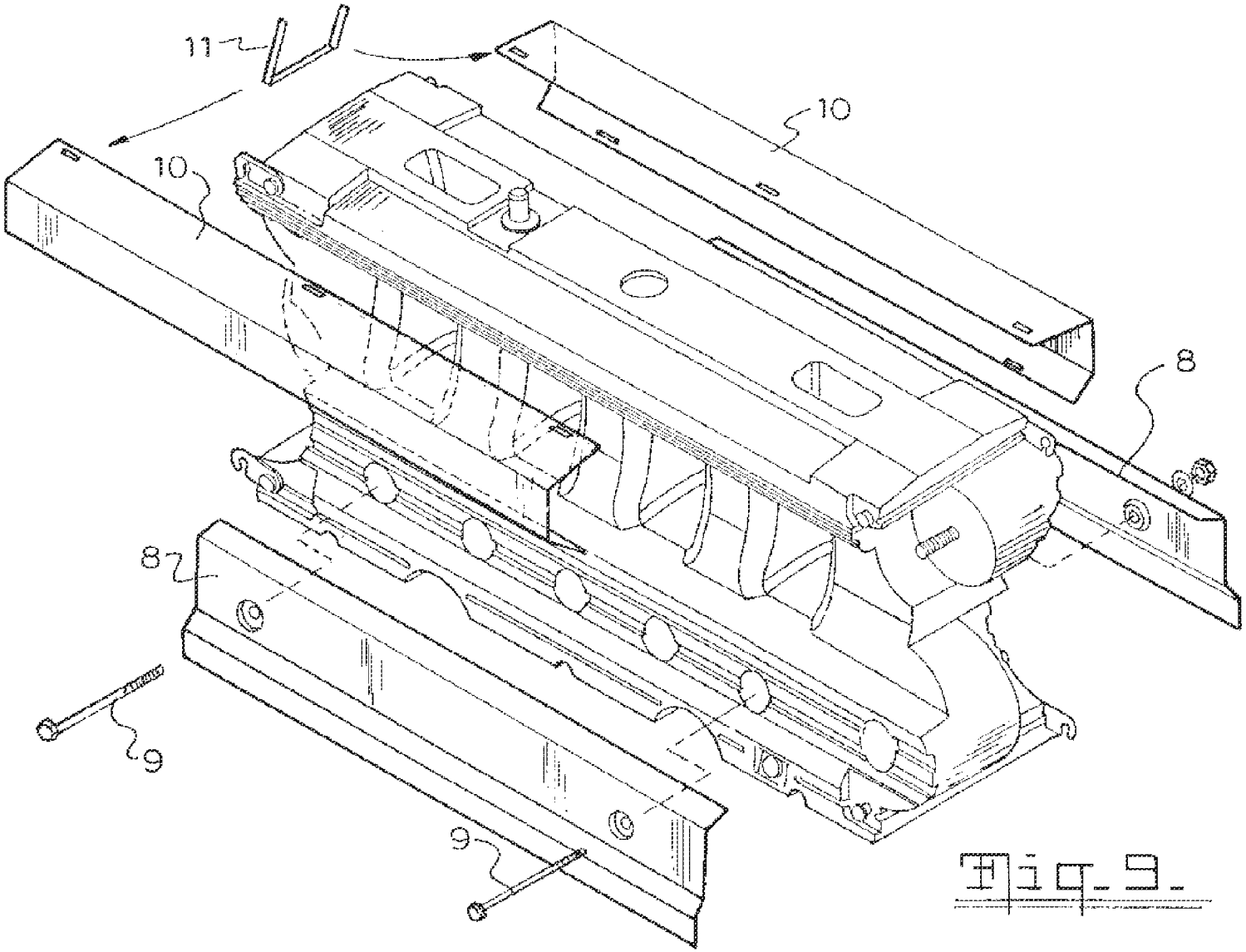
FIG. 9 is an exploded view of the cladding in FIG. 8.
Figure 10:
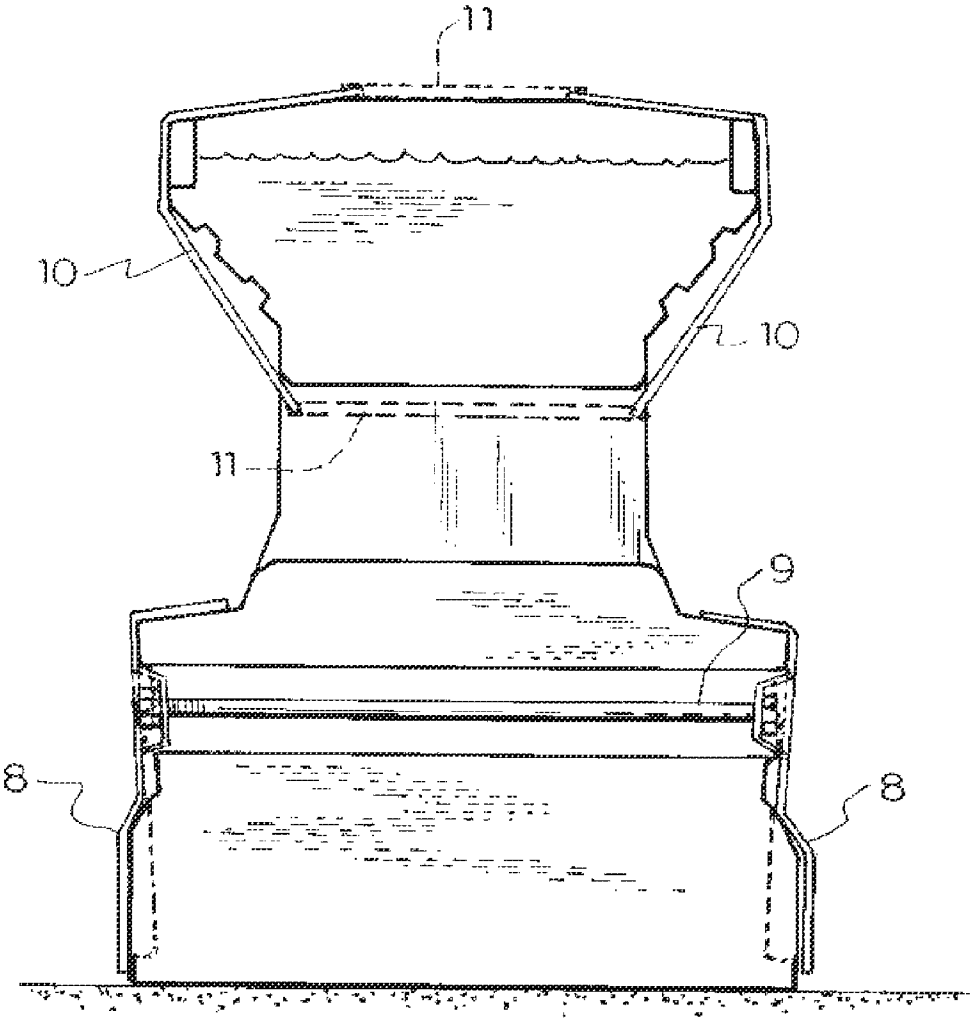
FIG. 10 is an elevation sectioned through the cladding restraining bolts and straps of FIG. 8.

It is also possible to clad the outside walls of modules 4 as shown in FIGS. 8, 9 and 10 with metal pressings to increase structural strength and to protect against damage when impacted by a vehicle. These Figures show pressings 8 secured to the lower side walls of module 4 by bolts 9 and pressings 10 secured to the upper side walls of module 4 by straps 11. These claddings add to the structural integrity of the barrier without detracting from neither its flexibility nor its ability to absorb impact energy.

Figure 12:
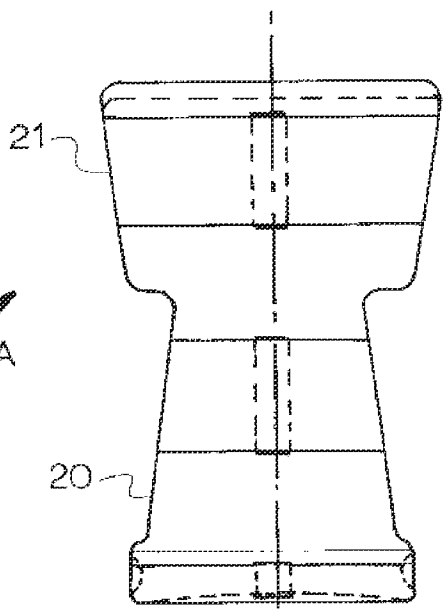
FIG. 12 is an end elevation of the module in FIG. 11.
Figure 11:
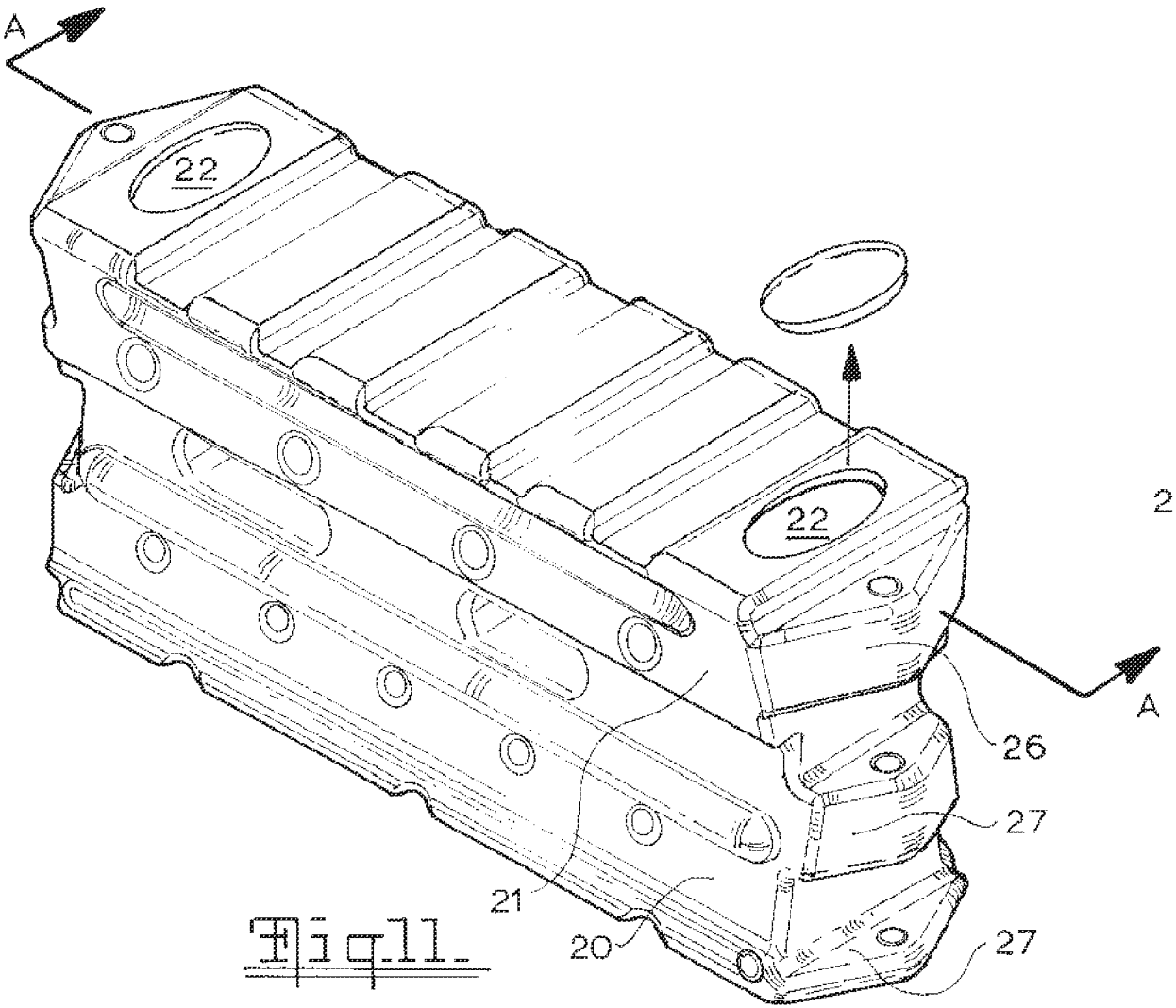
FIG. 11 is an isometric view of another alternative module in which modules are linked by vertical pins.
Figure 11:
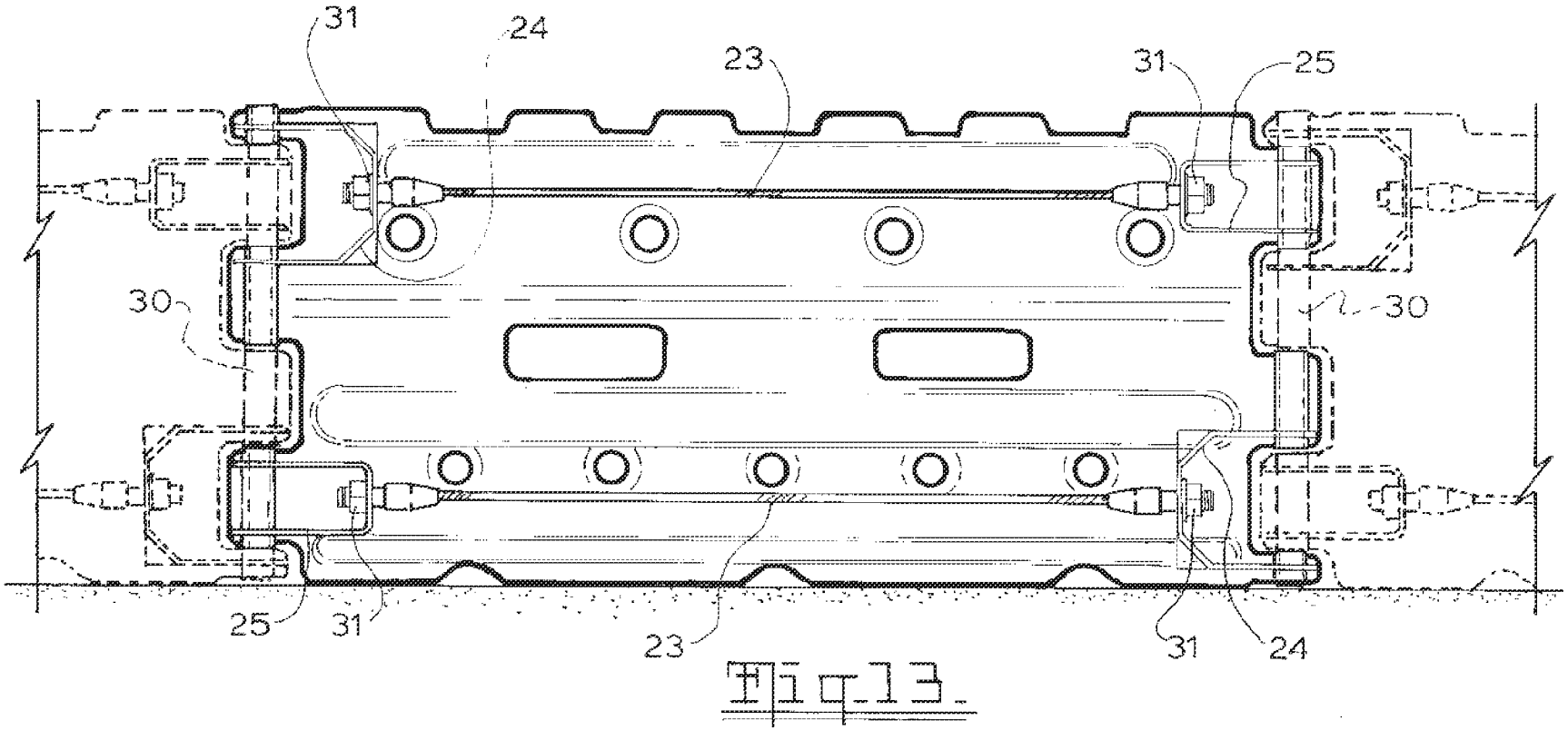
Figure 22:
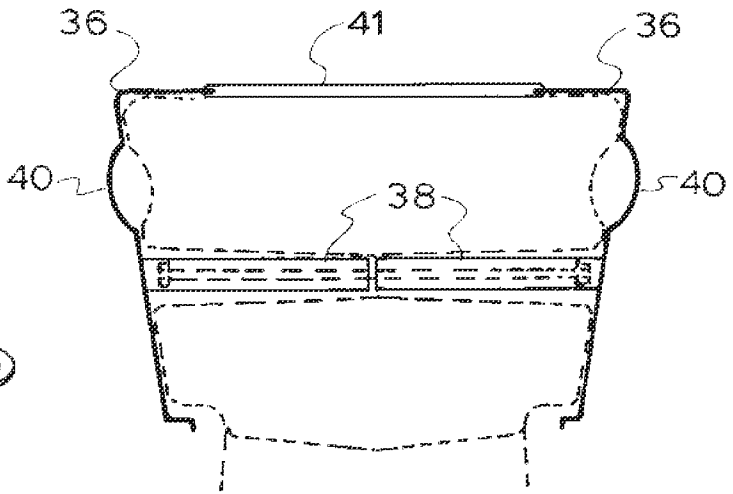
FIG. 22 is a partial elevation sectioned through a cladding fixing of FIG. 17.

FIGS. 11 and 12 illustrate another alternative module of different external shape and with different connecting means for the internal cables. The cross section of base 20 of the module is reduced from that of the module in FIG. 10 so that vehicle impact is primarily with upper section 21. This results in an impact which is safer and less damaging for the vehicle and occupants and also reduces the cladding required to prevent damage to the module as will be seen in FIGS. 20 to 22 described below.

Internal cables 23 shown in FIG. 13 are tensioned between C couplings 24 and 25 which are molded into hinge sections 26 and 27 of the module and engage vertical tube sections 28 and 29 also molded into hinge sections 26 and 27 in vertical alignment to receive pins 30 shown in dashed outline. Nuts 31 can be accessed through hatches 22 in the top section of the modules to tension cables 23.

Figure 14:
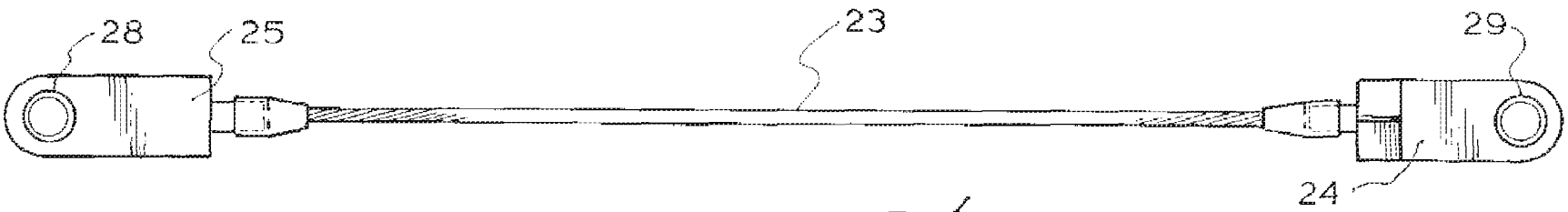
FIG. 14 is a plan view of a connecting cable in FIG. 11.
Figure 15:
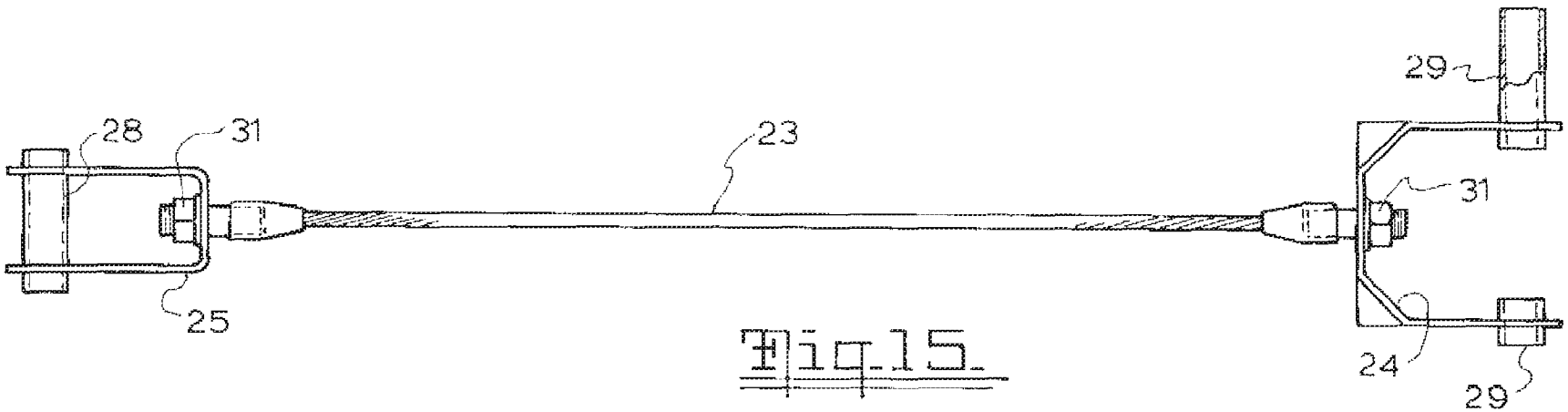
FIG. 15 is an elevation of the connecting cable of FIG. 14.
Figure 16:
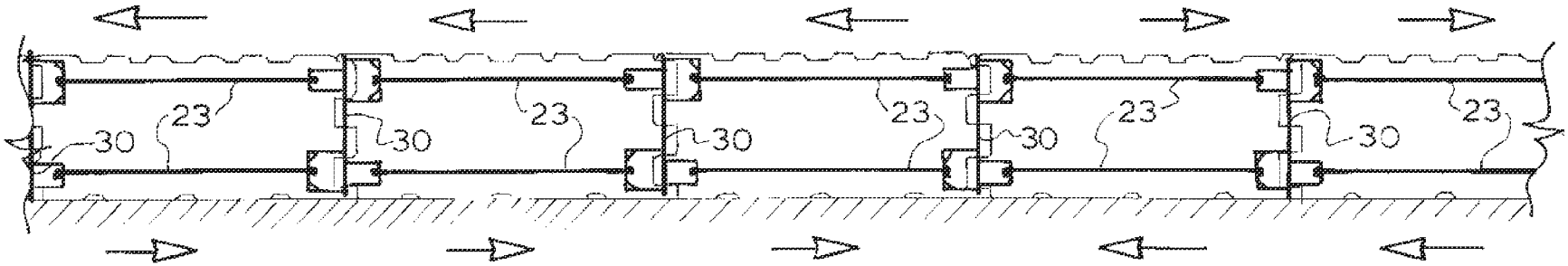
FIG. 16 is a plan view of a chain of connected modules.

FIGS. 14 and 15 show cables 23 engaging C couplings 24 and 25 via threaded end members and nuts 31. These entire cable assemblies including tube sections 28 and 29 are set up within the mold and so are embedded in hinge sections 26 and 27 during the molding operation. Accordingly when a chain of modules is linked with vertical pins 30 as illustrated in FIG. 16, cables 23 tie all the modules together in a structurally integrated barrier which is sufficiently rigid to contain an impacting vehicle but is sufficiently flexible, especially at the hinge points, to absorb the maximum amount of impact energy into the deforming barrier. Accordingly damage to the vehicle and its occupants is minimized in a "soft" impact.

As shown in FIGS. 13 and 16, the cables 23 of adjoining modules are configured in a substantially co-linear arrangement. This permits the connected cables to pull together as a one continuous cable, preferably under tension. By arranging the cables in a co-linear configuration, unintended forces (moment forces) at the mating structure may be reduced or eliminated.

Figure 17:
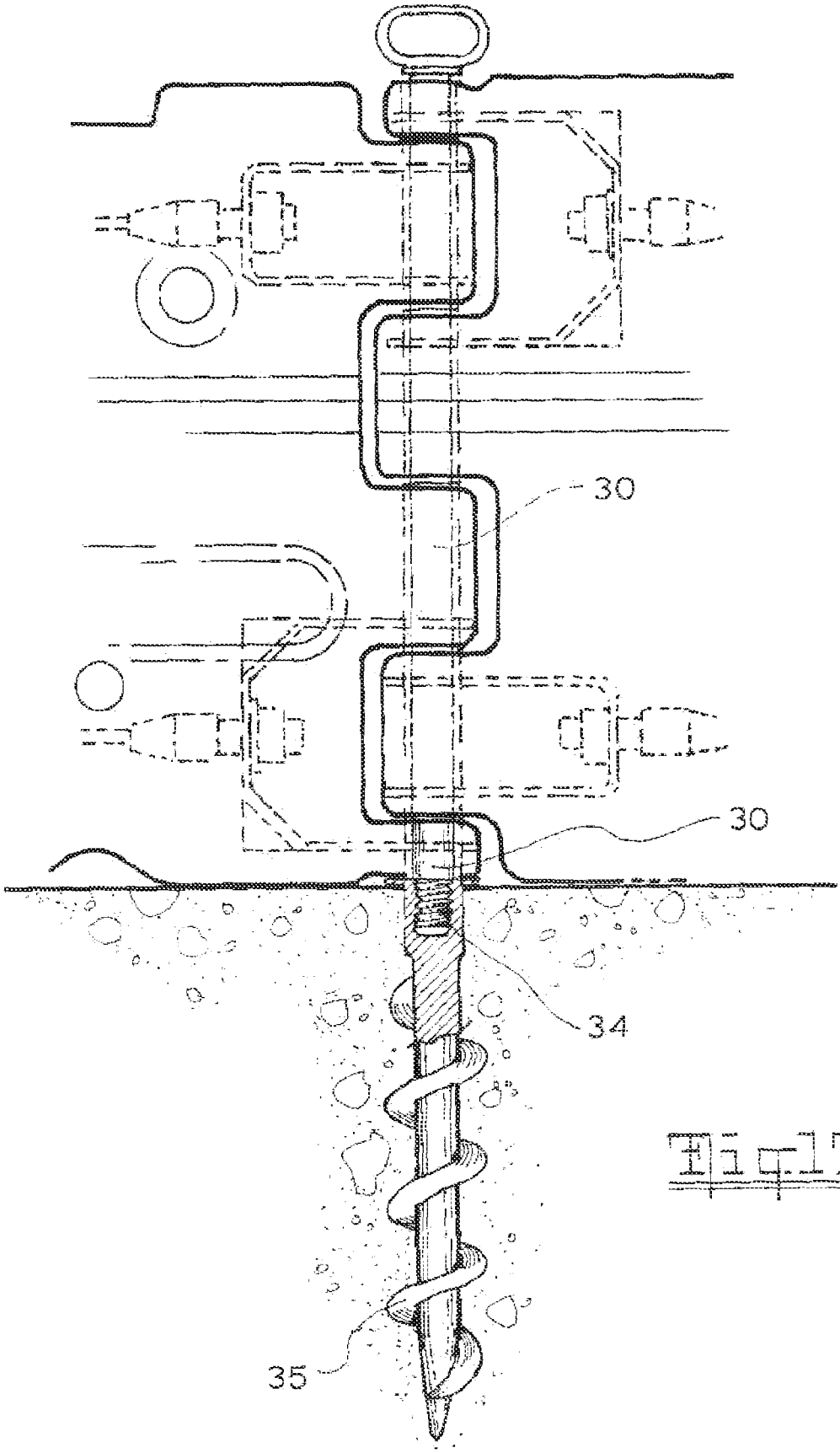
FIG. 17 is a sectioned elevation showing a ground anchoring device.
Figure 18:
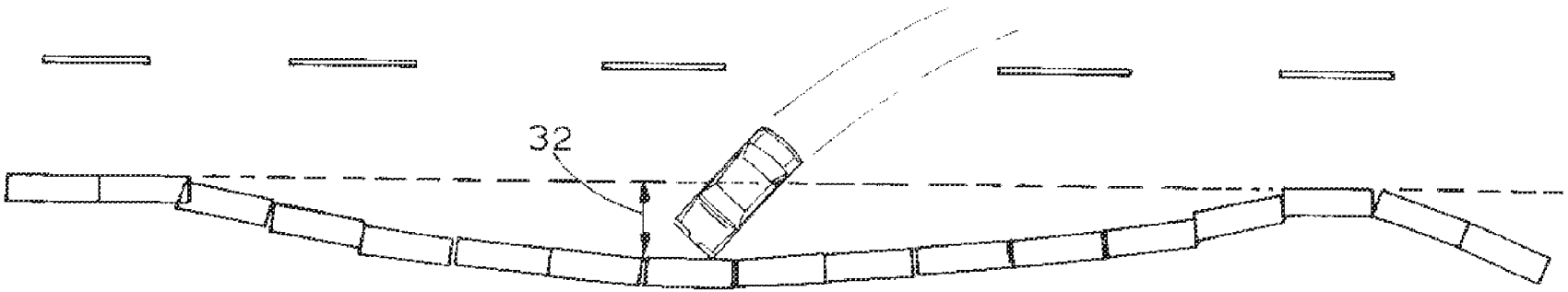
FIG. 18 illustrates a vehicle impacting a free standing chain of modules.
Figure 19:
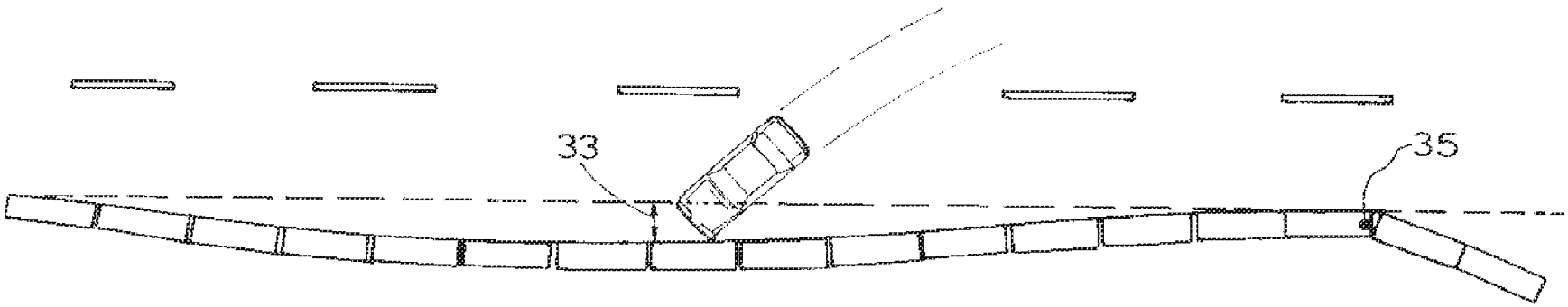
FIG. 19 illustrates a vehicle impacting a chain of modules where a leading member of the chain is anchored to the ground.

FIG. 18 illustrates such a "soft" impact where the barrier deflects by a deflection 32. However in some situations this unrestricted deflection is unacceptable owing to traffic space limitations and the ground anchor shown in FIG. 17 is used to restrain deflection 33 of the barrier as shown in FIG. 19. Anchoring is achieved by screwing threaded end 34 of pin 30 into auger 35 which itself has been screwed into the ground at a predetermined point before placement of the barrier. Accordingly the deflection of the barrier is limited to the extent required.

Figure 20:
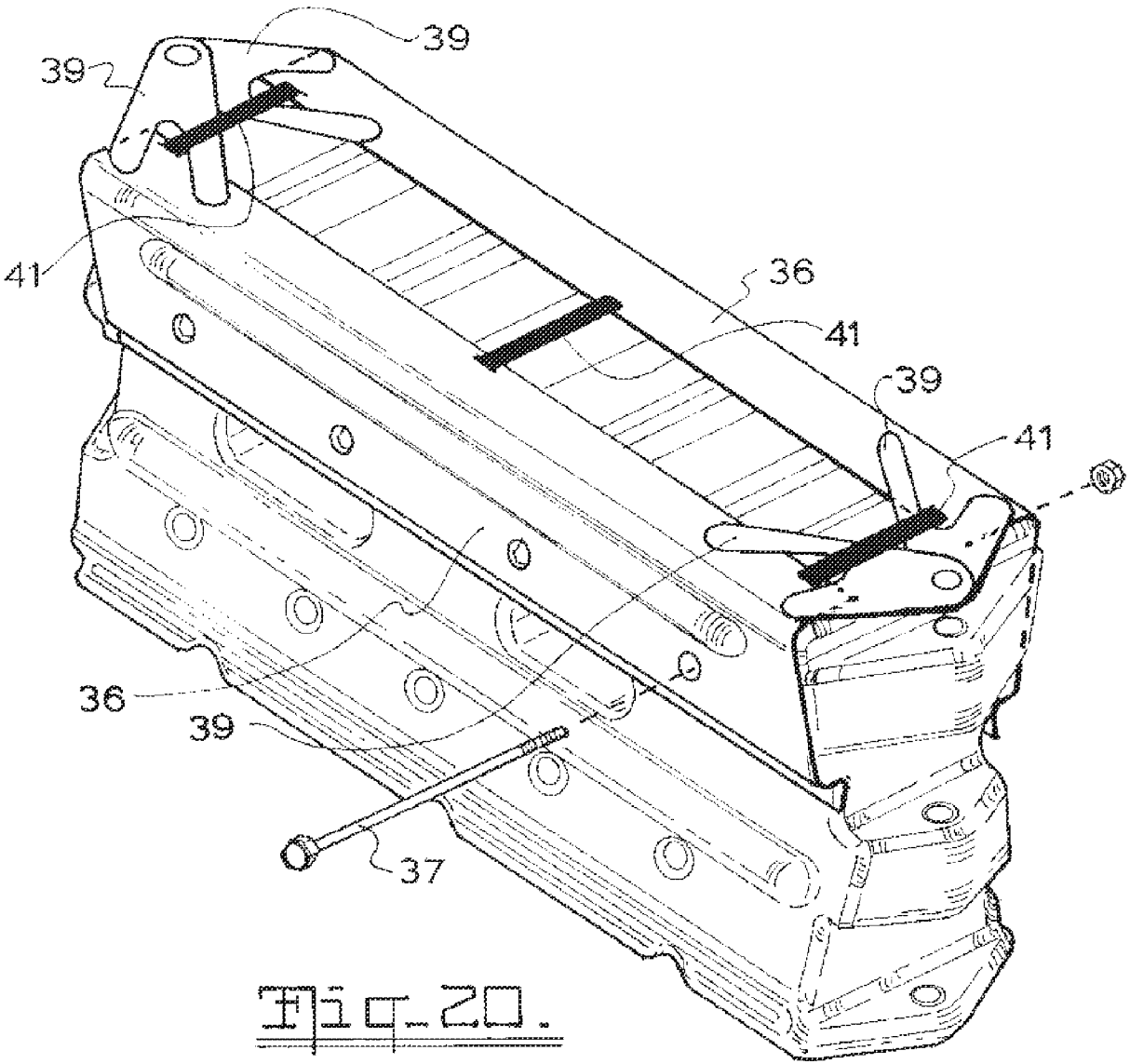
FIG. 20 is an isometric view of the module of FIG. 11 with metal cladding.
Figure 21:
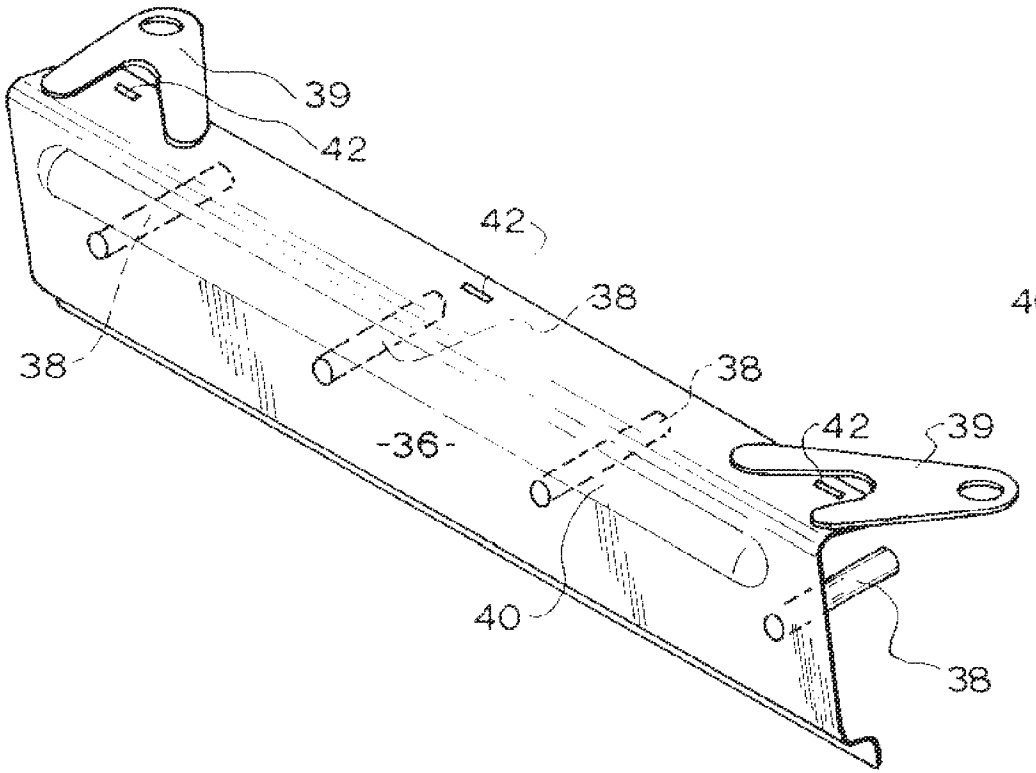
FIG. 21 is an isometric view of a cladding piece in FIG. 17.

In FIG. 20 pressed metal claddings 36 are shown in situ on the module secured by butterfly brackets 39 welded to claddings 36 and engaging connecting pins 30. Further securing is provided by bolts 37 passing through tube sections 38 welded to claddings 36 which also have scalloped longitudinal protrusions 40 to strengthen and protect the impact region of the module. Ties 41 between slots 42 in the top edge of claddings 36 secure claddings 36 to the top of the module.

Variations

It will be realized that the foregoing has been given by way of illustrative example only and that all other modifications and variations as would be apparent to persons skilled in the art are deemed to fall within the broad scope and ambit of the invention as herein set forth. Throughout the description and claims of this specification the words "comprise" and variations of that word such as "comprises" and "comprising" are not intended to exclude other additives components integers or steps.

The invention claimed is:

1. A road traffic barrier module comprising:

a hollow body having an interior and a first linking end and a second linking end in which the first and second linking ends comprise mating structures and in which the module is linked to adjoining modules by at least one connector passing through mating structures of the adjoining modules, wherein the hollow body is adapted at either linking end to link with similar adjoining modules to form a barrier, in which adjoining modules are linked by a vertical pin passing through mating structures of the adjoining modules; and a pair of longitudinal cables secured within the body interior and disposed between the first and second linking ends under tension to increase the structural integrity of the barrier, the ends of the cables attach to C couplings which are molded into the mating ends of the module and which are secured by the vertical pin, wherein the ends of the cables have threaded members which are retained in the C couplings by adjustable nuts.

2. The module of claim 1 in which there is a pair of upper and lower horizontal bolts passing through mating structures of adjoining modules and there is also a pair of cables the ends of which are also secured by the bolts.

3. The module of claim 2 in which the ends of the cables are formed in eyelets through which the bolts pass.

4. The module of claim 1 in which the ends of the cables are formed in eyelets through which the pin passes.

5. The module of claim 1 in which the C couplings engage tubes which are molded into the mating ends of the module and are aligned to receive the vertical pin.

6. The module of claim 1 in which the vertical pin is adapted to engage an anchor fixed in the ground beneath the module.

7. The module of claim 6 in which the lower end of the pin is threaded to screw into the top of an augur which is screwed into the ground as an anchor.

8. The module of claim 1 wherein the hollow body is molded from a plastic material and the walls of which are clad with metal pressings to increase the structural integrity of the module and to protect it against damage.

9. The module of claim 1 wherein the pair of longitudinal cables are connected to the mating structures at the first and second linking ends.

10. The module of claim 9 wherein the mating structures comprise a tension adjuster to adjust the tension of the cable.

11. The module of claim 9 wherein, when the module is coupled to an adjoining module, the at least one cable is coupled to a corresponding cable in the adjoining module such that the cables are configured in a substantially co-linear arrangement.

12. A road traffic barrier module comprising:

a hollow body having an interior and a first linking end and a second linking end, wherein the hollow body is adapted to link with similar adjoining modules at the linking ends to form a barrier, wherein the first and second linking ends comprise C couplings which are molded into mating ends of the module and wherein the module is linked to adjoining modules by a vertical pin passing through the C coupling and a complementary C coupling of the adjoining module; and at least one cable connected to the C couplings at the first and second linking ends and disposed within the body interior between the first and second linking ends under tension to increase the structural integrity of the barrier in which the ends of the cable have threaded members which are retained in the C couplings by adjustable nuts, wherein, when the module is coupled to an adjoining module, the at least one cable is coupled to a corresponding cable in the adjoining module such that the cables are configured in a substantially co-linear arrangement.

13. The module of claim 12 wherein the mating structures comprise a tension adjuster to adjust the tension of the cable.

14. The module of claim 12 comprising two cables longitudinally secured within the body interior and disposed between the first and second linking ends under tension to increase the structural integrity of the barrier.

15. The module of claim 13 comprising two cables longitudinally secured within the body interior and disposed between the first and second linking ends under tension to increase the structural integrity of the barrier.

16. A road traffic barrier comprising a plurality of coupled road traffic barrier modules that individually comprise:

a hollow body having an interior and a first linking end and a second linking end, wherein the hollow body is adapted to link with similar adjoining modules at the linking ends to form a barrier, wherein the first and second linking ends comprise mating structures and wherein the module is linked to adjoining modules by at least one connector passing through the mating structure and a complementary mating structure of the adjoining module; and at least one cable connected to the mating structures at the first and second linking ends and disposed within the body interior between the first and second linking ends under tension to increase the structural integrity of the barrier, wherein, when the module is coupled to an adjoining module, the adjoining modules are linked by a vertical pin passing through mating structures of the adjoining modules and there is a pair of longitudinal cables the ends of which are also secured by the pin, wherein the ends of the cables attach to C couplings which are molded into the mating ends of the module and which are secured by the vertical pin in which the C couplings engage tubes which are molded into the mating ends of the module and are aligned to receive the vertical pin, wherein the ends of the cables have threaded members which are retained in the C couplings by adjustable nuts to tension the cable, the at least one cable is coupled to a corresponding cable in the adjoining module such that the cables are configured in a substantially co-linear arrangement.

* * * * *